US011515648B2

(12) United States Patent
Liao et al.

(10) Patent No.: US 11,515,648 B2
(45) Date of Patent: Nov. 29, 2022

(54) DIPOLE ANTENNA

(71) Applicant: IQ Group Sdn. Bhd., Pulau Pinang (MY)

(72) Inventors: Shin-Hua Liao, New Taipei (TW); Chia-Chi Lin, New Taipei (TW); Zhi-Yuan Han, Jiu Jiang (CN)

(73) Assignee: IQ GROUP SDN. BHD., Pulau Pinang (MY)

( * ) Notice: Subject to any disclaimer, the term of this patent is extended or adjusted under 35 U.S.C. 154(b) by 57 days.

(21) Appl. No.: 17/167,436

(22) Filed: Feb. 4, 2021

(65) Prior Publication Data

US 2022/0247090 A1 Aug. 4, 2022

(51) Int. Cl.

| | |
|---|---|
| ***H01Q 9/28*** | (2006.01) |
| ***H01Q 21/06*** | (2006.01) |
| ***H01Q 21/00*** | (2006.01) |
| ***H01Q 9/18*** | (2006.01) |
| ***H01Q 1/48*** | (2006.01) |
| *H01Q 1/22* | (2006.01) |

(52) U.S. Cl.

CPC ..... *H01Q 21/062* (2013.01); *H01Q 1/48* (2013.01); *H01Q 9/18* (2013.01); *H01Q 21/0075* (2013.01); *H01Q 1/2291* (2013.01)

(58) Field of Classification Search

CPC .. H01Q 1/22–48; H01Q 9/285; H01Q 21/062; H01Q 21/0075

See application file for complete search history.

(56) References Cited

U.S. PATENT DOCUMENTS

| | | | | |
|---|---|---|---|---|
| 2005/0110696 | A1* | 5/2005 | Surducan | H01Q 9/285 343/700 MS |
| 2009/0295667 | A1* | 12/2009 | Ma | H01Q 1/2225 343/795 |
| 2010/0283688 | A1* | 11/2010 | Kinezos | H01Q 1/243 343/702 |
| 2020/0127383 | A1* | 4/2020 | Patton | H01Q 5/15 |

* cited by examiner

*Primary Examiner* — Hasan Islam

(74) *Attorney, Agent, or Firm* — Muncy, Geissler, Olds & Lowe, P.C.

(57) ABSTRACT

A dipole antenna is disclosed, which is formed on an electrical circuit substrate having a ground plane and comprises a first antenna group, a second antenna group and a feeding microstrip line, wherein the first antenna group and the second antenna group have the length of a quarter wavelength on the substrate, two feeding points are formed by the intersections of the individual vertical radiating metallic line and the radiating metallic line on two sides, and the feeding microstrip line is connected between the two vertical radiating metallic lines thereby enhancing the radiation signals.

10 Claims, 12 Drawing Sheets

DIPOLE ANTENNA

BACKGROUND OF THE INVENTION

1. Field of the Invention

The present invention relates to a dipole antenna, which is characterized in a type of high gain antenna structure for wireless modules or local area network systems.

2. Description of Related Art

At present, most of the antennas found inside the wireless module equipped into various electronic products simply have the single frequency-band operation capability. Therefore, it can be expected that, as the market gradually expands, the configured antennas having simply the wireless module with single-frequency operation capabilities are becoming insufficient in terms of their short-distance operating stability and future market competitiveness. As such, obviously, the development of high-gain antennas will be the mainstream trend of related electronic products in the future. It is known that the conventional technologies have been applied onto currently available operating devices, but, upon adjusting and operating the antenna to obtain the highest gain, the mutual matching relationship among the components of the antenna must be taken into consideration and can be quite complicated in practice.

In addition, since the current electronic products are developing towards features like low-cost, lightweight, thin, short, and small designs, it can be anticipated that the wireless modules equipped into various electronic products will accordingly be characterized in their low-cost, lightweight, slim shape as well. Under such circumstance, the volume of the antenna installed inside the wireless module will also be limited to a certain volume.

The conventional low-power short-distance Bluetooth applications generally have a transmission distance of about 20-30 meters, and the best low-cost design may reach about 50 meters; whereas, certain high-cost System In Package (SIP) integrating the internal RF chip antenna can also effectively achieve the performance of approximately 100 meters. Hence, to design the microstrip antenna having extremely high gain, long communication distance, low manufacture cost and miniaturization has been the goal of the industry's efforts.

Accordingly, the present invention provides a dipole antenna, wherein two antenna groups have a length of a quarter wavelength on the substrate and individually form two feeding points by means of the intersections of the respective vertical radiating metallic lines and the radiating metallic lines on both sides, and a feeding microstrip line is connected between such two feeding points or two vertical radiating metallic lines for conjunctively transmitting enhanced signals. With the design illustrated in the present invention, it is possible to increase high gain to perform stable single-frequency and long-distance operations, and offer appropriate capabilities for wireless module/local area network systems as well as desirable characteristics of low cost, lightness, thinness, and small size. These satisfy the current requirements on the volume reduction of the electronic product, so the present invention should be an optimal solution.

SUMMARY OF THE INVENTION

The present invention provides a dipole antenna which is formed on a substrate having a ground plane and comprises: a first antenna group, including a first radiating metallic line and a first vertical radiating metallic line, in which the intersection of the first radiating metallic line and the first vertical radiating metallic line is a first feeding point, and the end of the first vertical radiating metallic line remote from the first feeding point is connected to a signal source, while the end of the first radiating metallic line remote from the first feeding point is maintained at a distance from the ground plane; a second antenna group, including a second radiating metallic line and a second vertical radiating metallic line, in which the intersection of the second radiating metallic line and the second vertical radiating metallic line is a second feeding point, and the other ends of the second radiating metallic line and the second vertical radiating metallic line remote from the second feeding point are connected to the ground plane; and a feeding microstrip line, in which one end of the feeding microstrip line is connected to the first vertical radiating metallic line, which the other end thereof is connected to the second vertical radiating metallic line.

In a preferred embodiment, the first antenna group and the second antenna group have a nearly symmetrical feature on the front, rear, left and right sides and have a better vertical radiation performance.

In a preferred embodiment, the first antenna group and the second antenna group have a length of a quarter wavelength on the substrate and form a symmetrical pattern.

In a preferred embodiment, a part of the wire segment of the first radiating metallic line is in perpendicular or/and parallel correspondence with the first vertical radiating metallic line, and a part of the wire segment of the second radiating metallic line is in perpendicular or/and parallel correspondence with the second vertically radiating metallic line.

In a preferred embodiment, the first vertical radiating metallic line, the second vertical radiating metallic line or the feeding microstrip line are straight lines, and the first vertical radiating metallic line and the second vertical radiating metallic line are in a parallel configuration.

In a preferred embodiment, the first resonance path starting from the first radiating metallic line to the first vertical radiating metallic line is used to define the first operating frequency of the dipole antenna, and the second resonance path starting from the second radiating metallic line to the second vertical radiating metallic line is used to define the second operating frequency of the dipole antenna.

In a preferred embodiment, the first antenna group is at the first operating frequency 2.3-2.45 GHz and the wire length is 31-35 mm, and the second antenna group is at the second operating frequency 2.35-2.5 GHz and the wire length is 28-33 mm, such that the wire length is adjusted based on the frequency changes thereby achieving the optimal antenna gain.

In a preferred embodiment, the substrate includes a first surface and a second surface, the first antenna group and the second antenna group are arranged on the first surface, and the second surface has a circuit configuration area and the ground plane.

In a preferred embodiment, the first radiating metallic line and the second radiating metallic line are configured on the substrate in a planar or spiral shape.

In a preferred embodiment, the two ends of the feeding microstrip line are respectively connected to the first feeding point and the second feeding point.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1A:
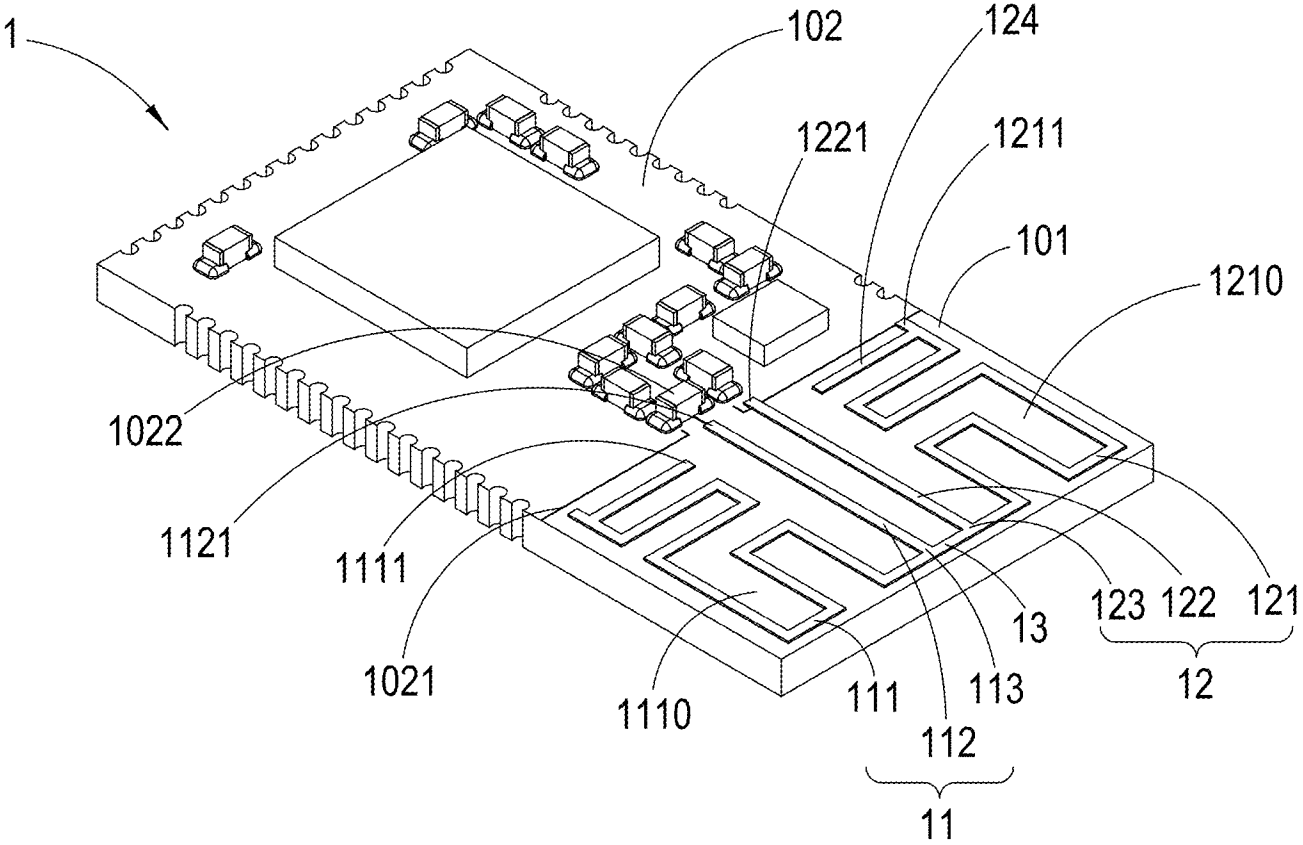
FIG. 1A shows a structural view for a first embodiment of the dipole antenna according to the present invention.

Please refer to FIG. 1A, wherein a structural view for a first embodiment of the dipole antenna according to the present invention is shown. It can be seen from the Figure that the dipole antenna illustrated in the present embodiment is formed on a substrate 1 (e.g., a microwave substrate) which is composed of a wireless module circuit board with a size of 21.3×11.6 $mm^2$ and is typically a printed circuit board made of glass fiber reinforced BT (Bismaleimide-Triazine) resin or FR4 glass fiber reinforced epoxy resin, or alternatively a flexible film substrate made of polyimide, but also certainly can be a ceramic substrate made of Teflon, alumina or magnesium titanate demonstrating satisfactory characteristics at high frequencies.

The substrate 1 includes a first surface 101 and a second surface 102, in which the dipole antenna is printed on the surface 101, while the second surface 102 is configured as an electrical circuit allocation area to provide circuit component layout and wiring; the second surface 102 is also printed with a ground plane 1021 for the grounding purpose of a wireless module. In this embodiment, the first surface 101 and the second surface 102 are located on the same plane, but it is not used to limit the scope of the present patent application. That is, the first surface 101 and the second surface 102 can also be configured on different planes; for example, the second surface 102 is arranged on the front surface of the substrate 1 and the first surface 101 is arranged on the rear side of the substrate 1.

Because of the planarization characteristics with respect to the design structure of the substrate 1 in the present invention, and the high integration between the dipole antenna and the system circuit of the substrate 1, it can be appreciated that the present invention provides not only the features of lightness, thinness, and small size, but also meets the requirements on the electronic product volume reduction.

The illustrated dipole antenna comprises:

a first antenna group 11, including at least a first radiating metallic line 111 and a first vertical radiating metallic line 112, in which one end 1121 of the first vertical metallic line 112 is connected to a signal source 1022 (i.e. the RF signals) for receiving the transmission signals, while the other end is connected to the first radiating metallic line 111, and the intersection part is referred as a first feeding point 113 which is applied to transmit signals; meanwhile, the end 1111 of the first radiating metallic line 111 remote from the first feeding point 113 is not connected to the ground plane 1021 and is kept at a distance from the ground plane 1021, and such a separation distance is used to adjust the matching with the ground so that the first antenna group 11 can operate as a radio frequency radiation part;

a second antenna group 12, located on one side of the first antenna group 11 and including at least a second radiating metallic line 121 and a second vertical radiating metallic line 122, in which the ends 1211, 1221 of the second radiating metallic line 121 and the second vertical radiating metallic line 122 are connected to the ground plane 1021, while the other ends of the second radiating metallic line 121 and the second vertical radiating metallic line 122 are mutually connected, the intersection is referred as a second feeding point 123 which is applied to transmit signals so that the second antenna group can form a ground part; besides, a wire segment 124 is configured near the ground plane 1021 for compensation matching; and a feeding microstrip line 13, connected between the first feeding point 113 and the second feeding point 123; in the present embodiment, the feeding microstrip line 13 has a characteristic impedance of 50 ohms and connects the radio frequency end and the ground end to achieve the purpose of signal transmission enhancement.

The first radiating metallic line 111 has the following characteristics:

(1) The first radiating metallic line 111 meanders through multiple connected channels 1110 from the first feeding point 113 towards different directions (up, down, left, right or tilt), with the width and length of each of such channels 1110 being the same or different, and the bending angle or included angle formed between each two of such channels 1110 being the same or different as well.

(2) A part of the wire segment of the first radiating metallic line 111 is correspondingly vertical or/and parallel to the first vertical radiating metallic line 112.

(3) The first radiating metallic line 111 is arranged on the substrate 1 in a planar condition.

(4) At the operating frequency 2.3-2.45 GHz, the optimal wire length of the first antenna group 11 can be 31-35 mm (such a wire length is measured from the end 1121 of the first vertical radiating metallic line 121 to the end 1111 of the first radiating metallic line 111), and can be suitably adjusted according to the frequency changes, including 31 mm, 32 mm, 33 mm, 34 mm and 35 mm.

(5) The wire length of the first radiating metallic line 111 can be adjusted according to different plane structure changes; in case that the area of the first surface 101 is 7*12 mm, the optimal wire length can be 31-35 mm, including 31 mm, 32 mm, 33 mm, 34 mm and 35 mm.

Moreover, the second radiating metallic line 121 has the following characteristics:

(1) The second radiating metallic line 121 meanders through multiple connected channels 1210 from the second feeding point 123 towards different directions (up, down, left, right or tilt), with the width and length of each of such channels 1210 being the same or different, and the bending angle or included angle formed between each two of such channels 1210 being the same or different as well.

(2) A part of the wire segment of the second radiating metallic line 121 is correspondingly vertical or/and parallel to the second vertical radiating metallic line 122.

(3) The second radiating metallic line 121 is arranged on the substrate 1 in a planar condition.

(4) At the operating frequency 2.35-2.5 GHz, the optimal wire length of the second antenna group 12 can be 28-33 mm (such a wire length is measured from the end 1211 of the second vertical radiating metallic line 121 to the end 1221 of the second radiating metallic line 122, and the wire segment 124 near the ground plane 1021 is used for matching compensation, thus not included in the length measurement), and can be suitably adjusted according to the frequency changes, including 28 mm, 29 mm, 30 mm, 31 mm, 32 mm and 33 mm.

(5) The wire length of the second radiating metallic line 121 can be adjusted according to different plane structure changes; in case that the area of the first surface 101 is 7*12 mm, the optimal wire length can be 28-33 mm, including 28 mm, 29 mm, 30 mm, 31 mm, 32 mm and 33 mm.

In addition, the first radiating metallic line 111 and the second radiating metallic line 121 present a left-right symmetrical pattern on both sides of the first vertical radiating metallic line 112 and the second vertical radiating metallic line 122.

Also, the wire widths of the first radiating metallic line 111, the first vertical radiating metallic line 112, the second radiating metallic line 121 or the second vertical radiating metallic line 122 can be the same or different; for example, in case the frequency is 2.3-2.5 GHz, the best wire width is 0.25-0.35 mm, including 0.25 mm, 0.3 mm and 0.35 mm.

Besides, the first resonance path starting from the first radiating metallic line 111 to the first vertical radiating metallic line 112 is used to define the first operating frequency of the dipole antenna, and the second resonance path starting from the second radiating metallic line 121 to the second vertical radiating metallic line 122 is used to define the second operating frequency of the dipole antenna, in which the second operating frequency is higher than the first operating frequency.

Besides, compared with the prior art, upon determining to perform the single-frequency operation, the relationship among such applied components needs to be considered, and the dipole antenna according to the present invention is achieved by individually adjusting the wire lengths of the first radiating metallic line 111 and the second radiating metal 121 thereby conveniently adjusting the frequencies (i.e., the first operating frequency and the second operating frequency) of the two resonance modes in the dipole antenna in order to reach the frequency band required by the wireless module/local area network system.

Figure 1B:
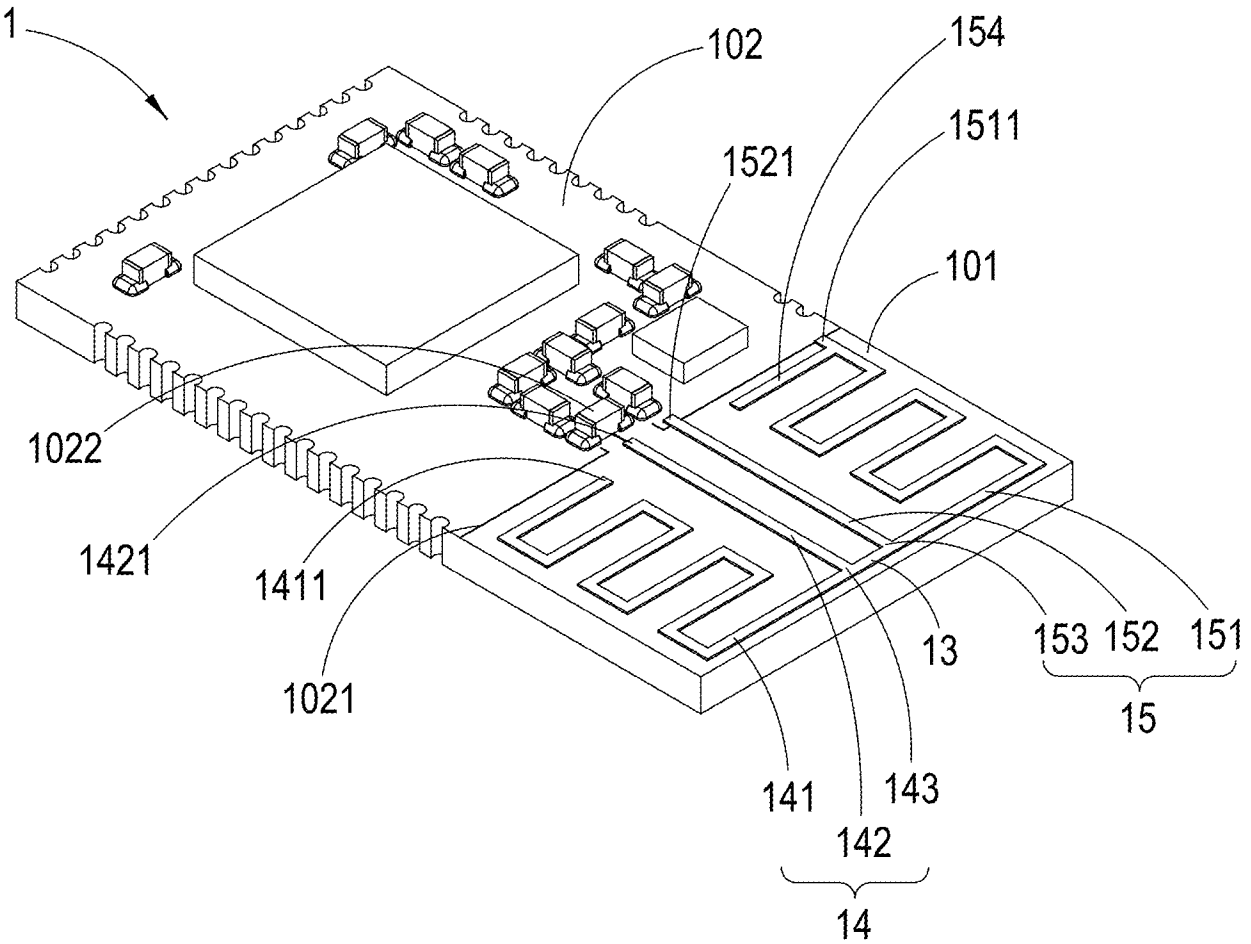
FIG. 1B shows a structural view for a second embodiment of the dipole antenna according to the present invention.

With respect to the antenna structure, in addition to the configuration disclosed in FIG. 1A, it can be seen that FIG. 1B also shows a third antenna group 14 having a third radiating metallic line 141, a third vertical metallic line 142 as well as a fourth antenna group 15 having a fourth radiating metallic line 151 and a fourth vertical radiating metallic line 152, in which the wire layout paths of the third radiating metallic line 141 and the fourth radiating metallic line 151 extending from the third feeding point 143 and the fourth feeding point 153 are obviously different from the approach demonstrated in FIG. 1A. Moreover, in FIG. 1B, one end 1421 of the third vertical radiating metallic line 142 remote from the third feeding point 142 in the third antenna group 14 is connected to the signal source 1022, while the other end 1411 of the third radiating metallic line 141 remote from the third feeding point 143 is not connected to the ground plane; additionally, the ends 1511, 1521 of the fourth radiating metallic line 151 and the fourth vertical radiating metallic line 152 remote from the fourth feeding point 153 in the fourth antenna group 15 are both connected to the ground plane 1021 for grounding purpose; similarly, the fourth antenna group 15 also includes a wire segment 154 for compensation matching.

Figure 1C:
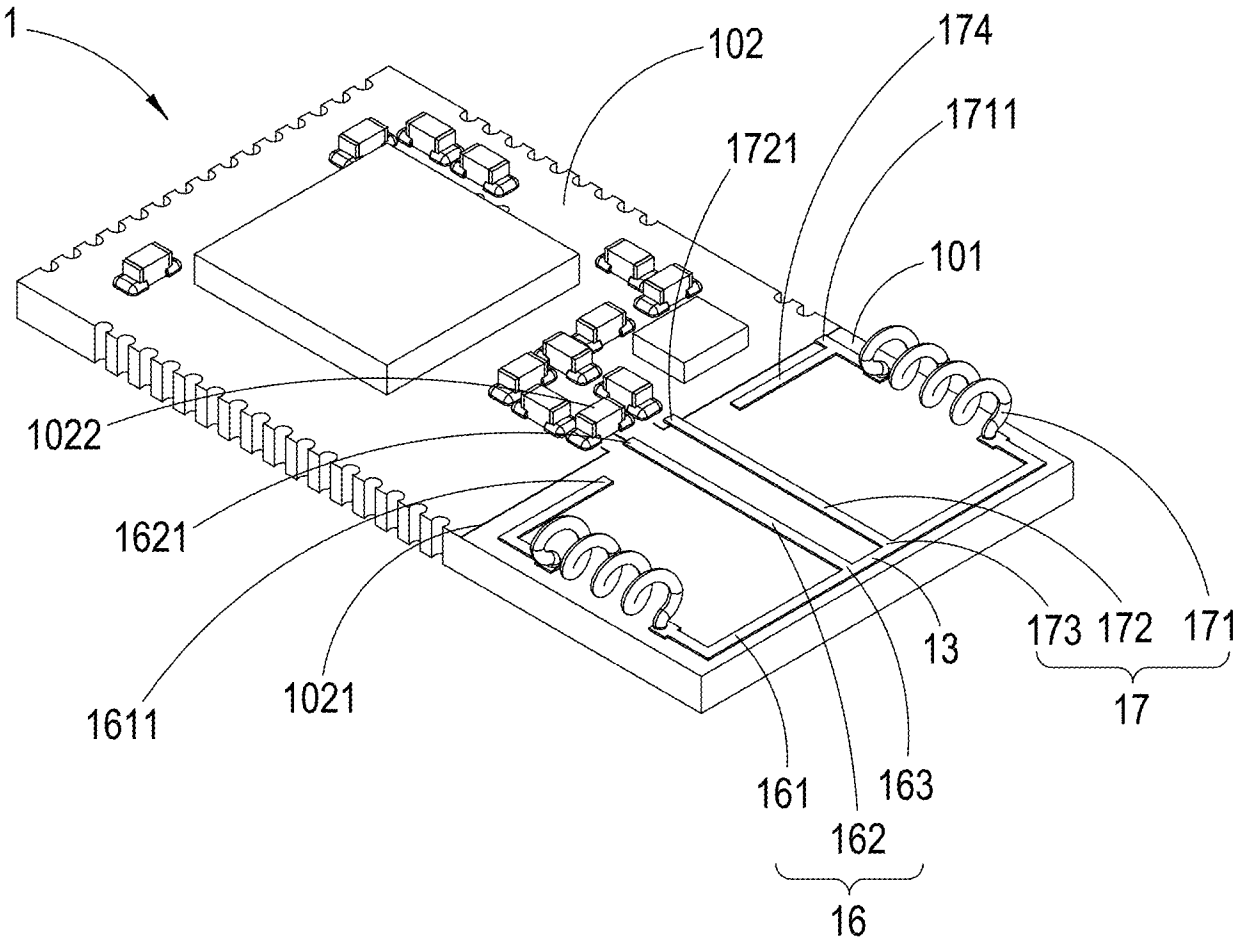
FIG. 1C shows a structural view for a third embodiment of the dipole antenna according to the present invention.

As further shown in FIG. 1C, it can be observed that the fifth antenna group 16 includes a fifth radiating metallic line 161 and a fifth vertical radiating metallic line 162 as well as the sixth antenna group 17 includes a sixth radiating metallic line 171 and a sixth vertical radiating metallic line 172, in which the travel paths of the fifth radiating metallic line 161 and the sixth radiating metallic line 171 extending from the fifth feeding point 163 and the sixth feeding point 173 are significantly different from the configurations shown in FIGS. 1A and 1B; in particular, the most special feature in the present embodiment lies in that a certain part of the wire segments of the fifth radiating metallic line 161 and the sixth radiating metallic line 171 are presented in a spiral shape. Herein one end 1621 of the fifth vertical radiating metallic line 162 remote from the fifth feeding point 163 is connected to a signal source 1022, while one end 1611 of the fifth radiating metallic line 161 remote from the fifth feeding point 163 is kept at a distance from the ground plane 1021, instead of being connected thereto. In addition, the ends 1711, 1731 of the sixth radiating metallic line 171 and the sixth vertical radiating metallic line 172 remote from the sixth feeding point 173 are both connected to the ground plane 1021, and the sixth antenna group 15 also similarly includes a wire segment 174 for compensation matching.

Figure 1D:
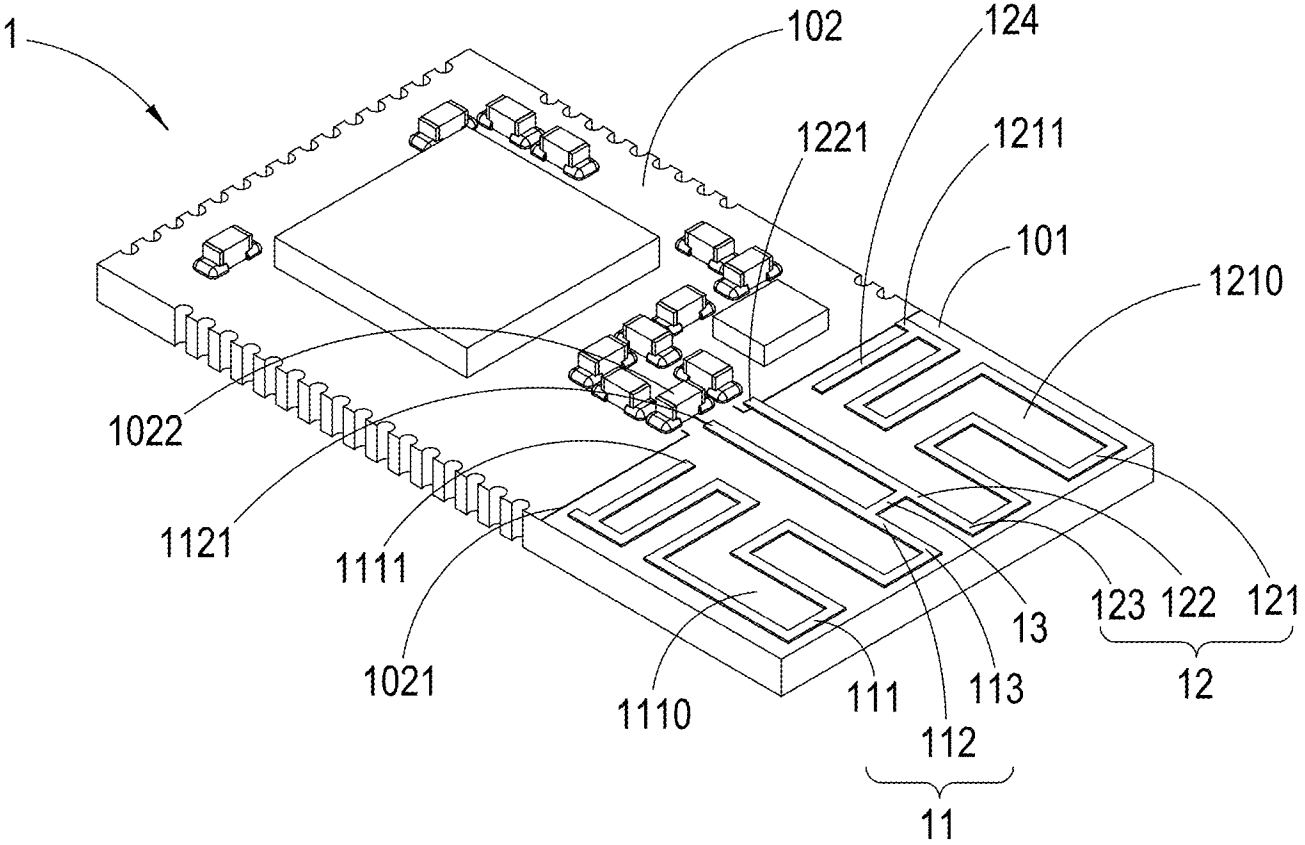
FIG. 1D shows a structural view for a fourth embodiment of the dipole antenna according to the present invention.

Next, referring to FIG. 1D, a fourth embodiment of the present invention is shown, wherein one end of the feeding microstrip line 13 is connected to the first vertical metallic line, and the other end is connected to the second vertical metallic line, thereby similarly achieving the objective of antenna gain enhancement.

It can be appreciated that, if one of the antenna groups in the present invention is connected to the RF signal source, then the other antenna group can be connected to the ground plane 1021; therefore, in the present invention, the location of the first antenna group 11 or the second antenna group 12 is not restricted to be on the left or right side of the substrate 1.

In practice, the present invention adopts a microwave substrate 1 having a relative dielectric constant of 4.4 and a thickness of 1.0 mm, and a single-frequency dipole antenna with an area of 7×11.6 mm2, wherein the first radiating metallic line 111 has a length of 25 mm and a width of 0.3 mm, while the length of the second radiating metallic line 121 is 25 mm and the width is 0.3 mm; additionally, the length of the first and second vertical radiating metallic lines 112, 122 is 6.8 mm and the width thereof is 0.3 mm. The following experimental results can be obtained.

Figure 2A:
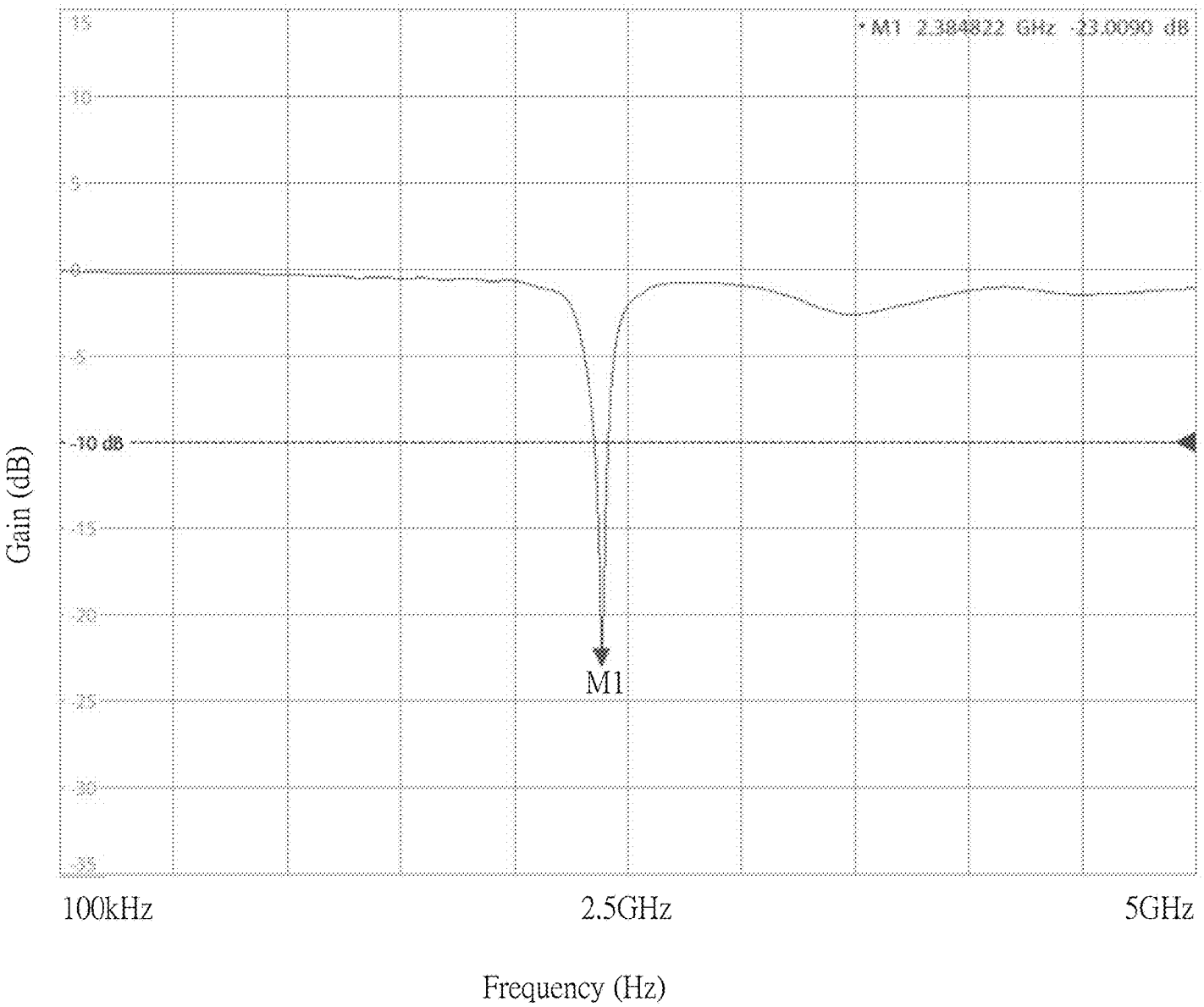
FIG. 2A shows a result diagram of the return loss measurement for the first embodiment of the dipole antenna according to the present invention.
Figure 2B:
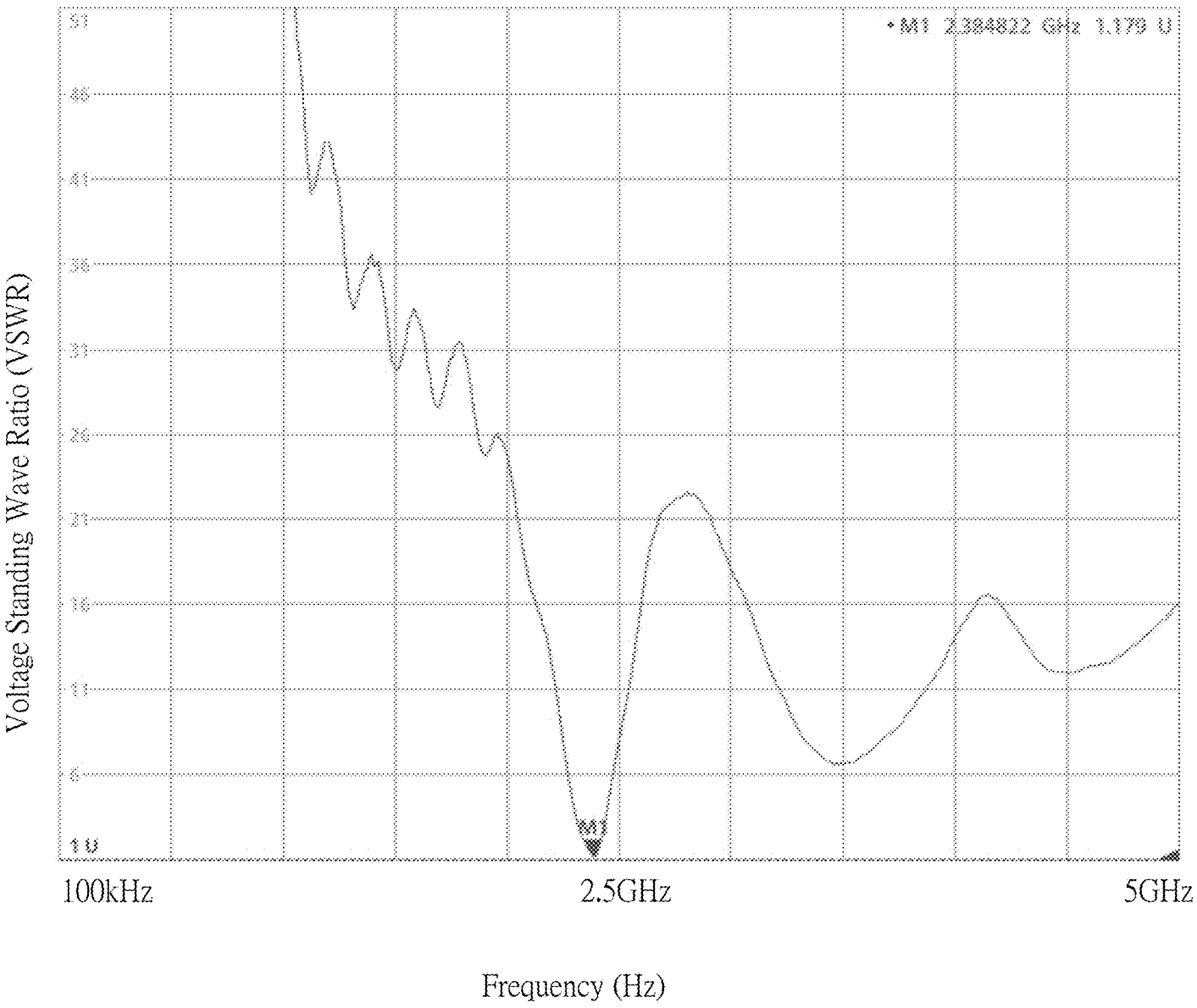
FIG. 2B shows a result diagram of the voltage standing wave ratio (VSWR) for the first embodiment of the dipole antenna according to the present invention.

In the present invention, the aforementioned antenna structures are respectively measured, and the measurement results are recorded, as below:

(1) By in-field measuring in accordance with the structure illustrated in FIG. 1A, as shown in FIGS. 2A and 2B, it can be observed that, under the definition of return loss impedance bandwidth of −10 dB, the first operating frequency of the dipole antenna is 2.3-2.45 GHz and the second operating frequency thereof is 2.35-2.5 GHz, so that, at the resonance frequency, the best gain effect is −23 db (as shown in FIG. 2A) and the standing wave ratio is 1.17 U (as shown in FIG. 2B), thus achieving the best gain result with less losses and meeting the bandwidth requirements of single-frequency wireless local area network systems.

Figure 3A:
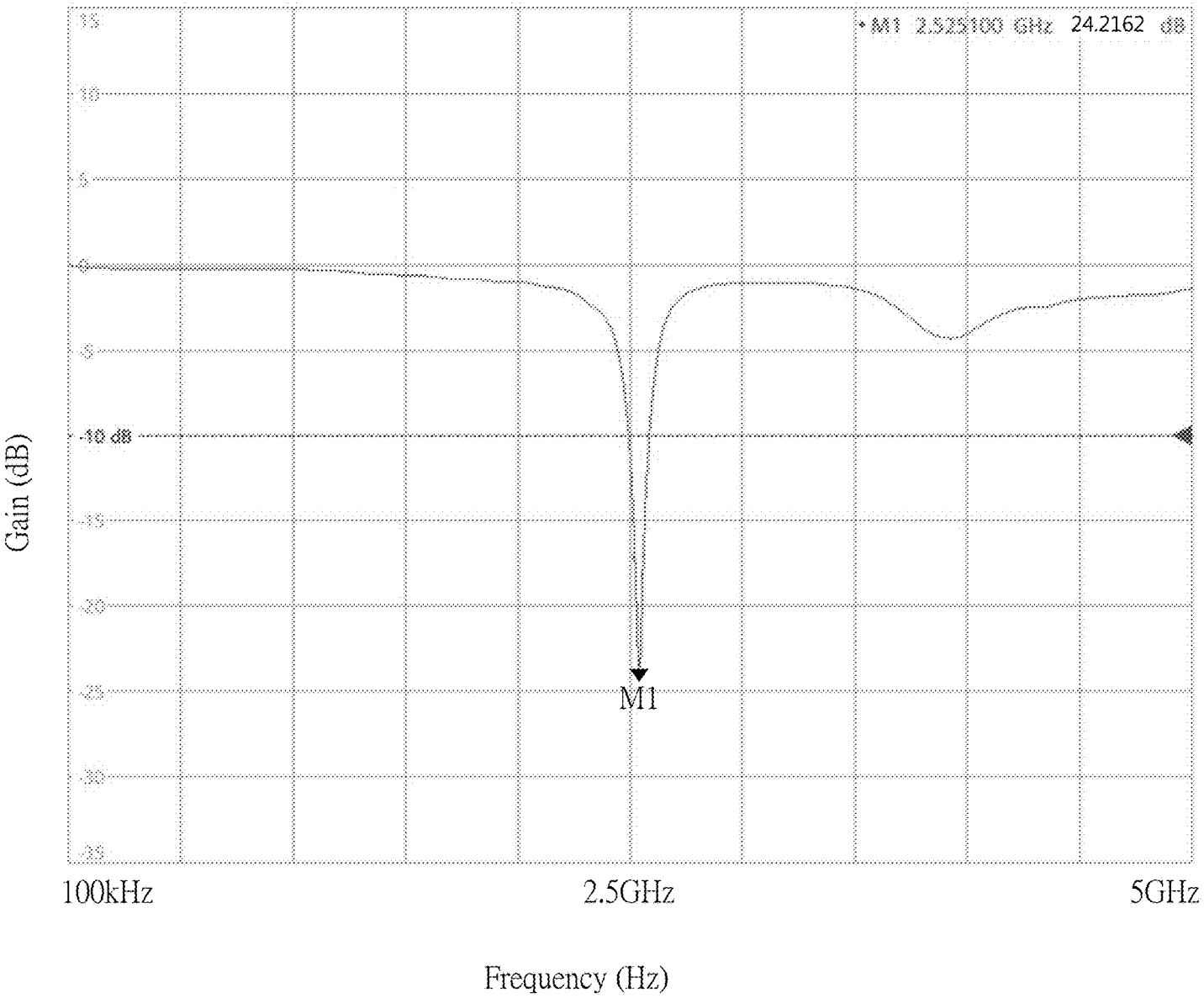
FIG. 3A shows a result diagram of the return loss measurement for the third embodiment of the dipole antenna according to the present invention.
Figure 3B:
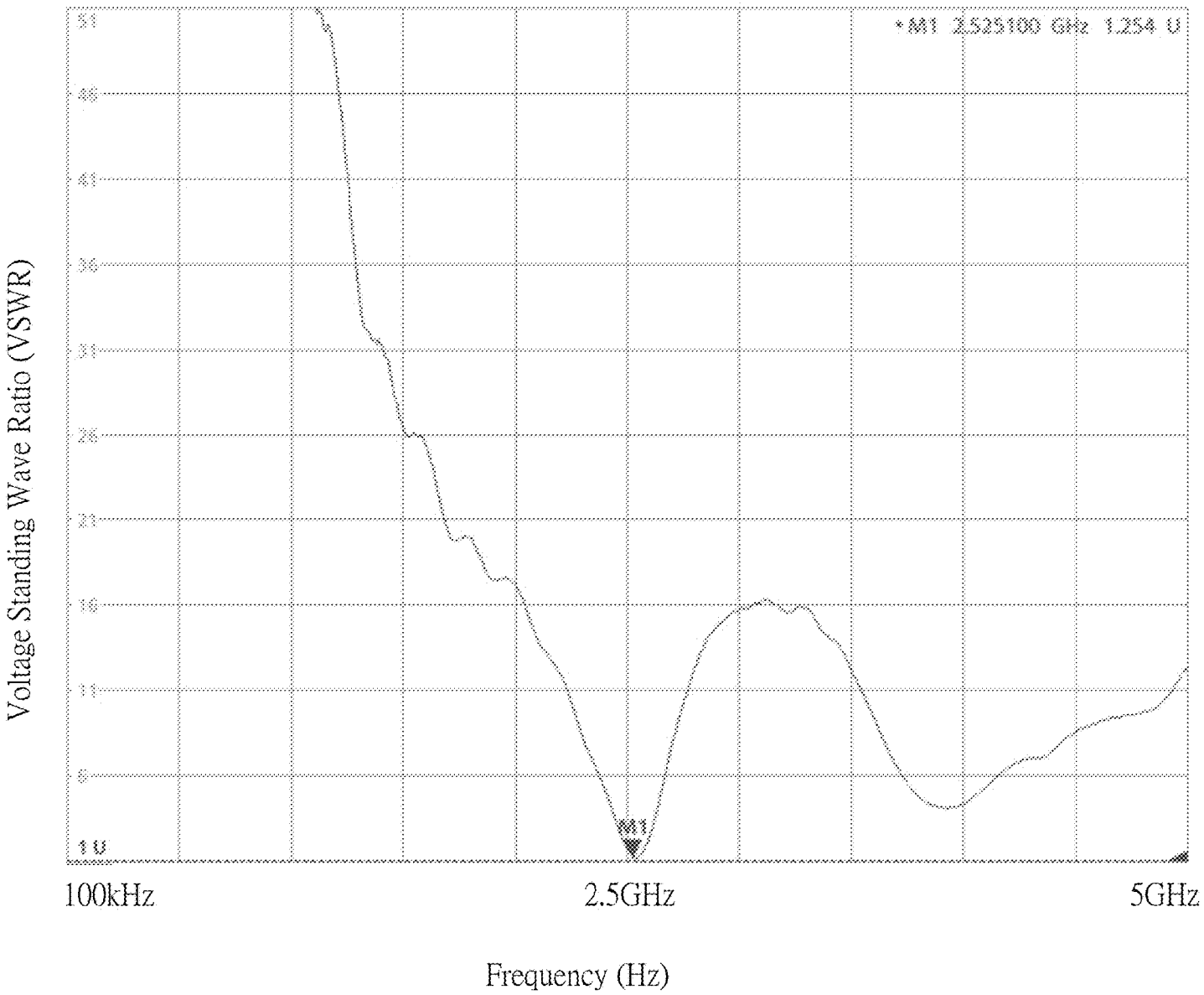
FIG. 3B shows a result diagram of the voltage standing wave ratio (VSWR) for the third embodiment of the dipole antenna according to the present invention.

(2) Then, by in-field measuring in accordance with the structure illustrated in FIG. 1C, as shown in FIGS. 3A and 3B, it can be observed that, under the definition of return loss impedance bandwidth of −10 dB, the first operating frequency of the dipole antenna is 2.3-2.45 GHz and the second operating frequency thereof is 2.35-2.5 GHz, so that the best gain effect is −24.2 db (as shown in FIG. 3A) and the standing wave ratio is 1.25 U (as shown in FIG. 3B), thus achieving the best gain result with less losses and meeting the bandwidth requirements of single-frequency wireless local area network systems.

Figure 4A:
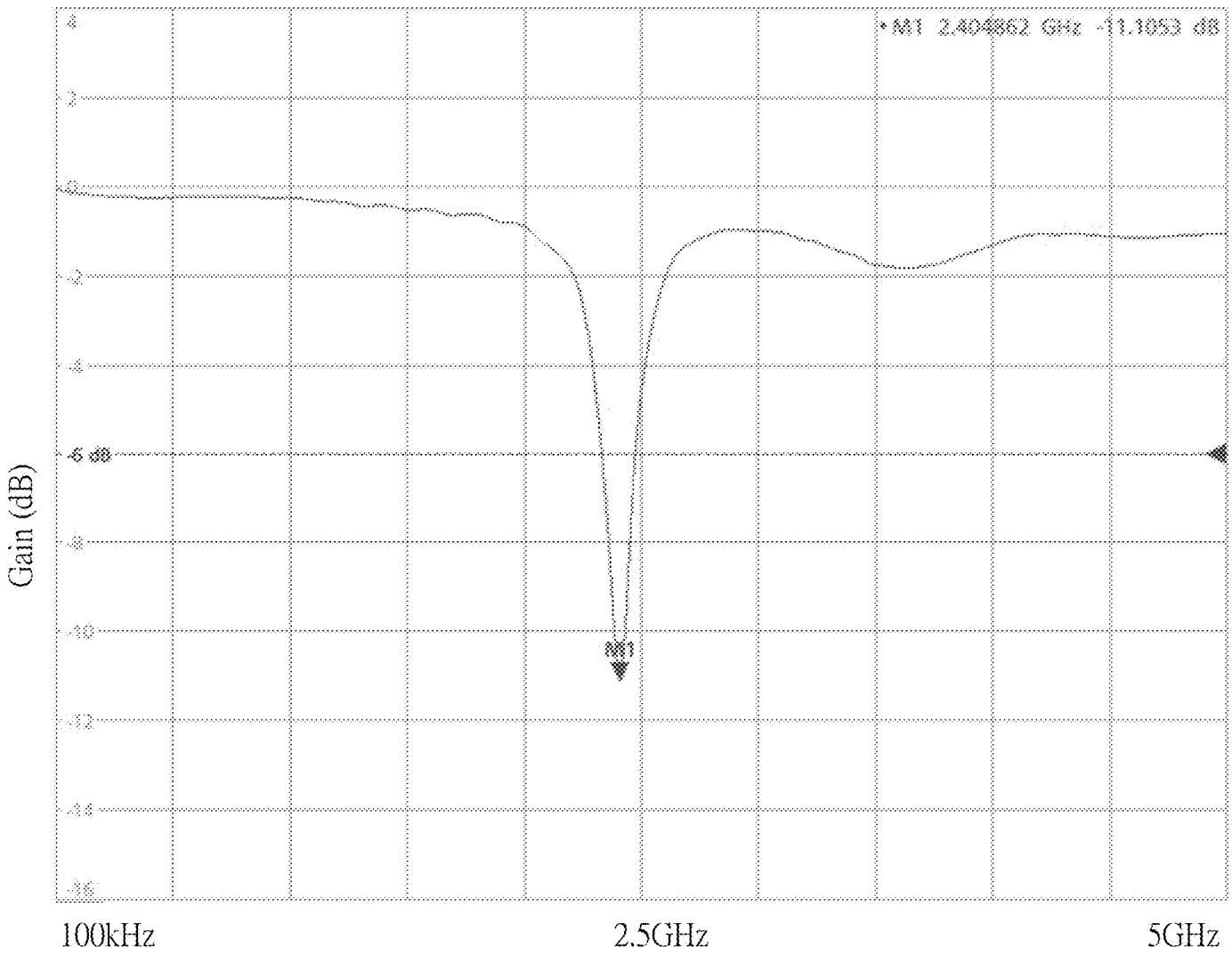
FIG.4A PRIOR ART
FIG. 4A shows a result diagram of the return loss measurement for a conventional dipole antenna.
Figure 4B:
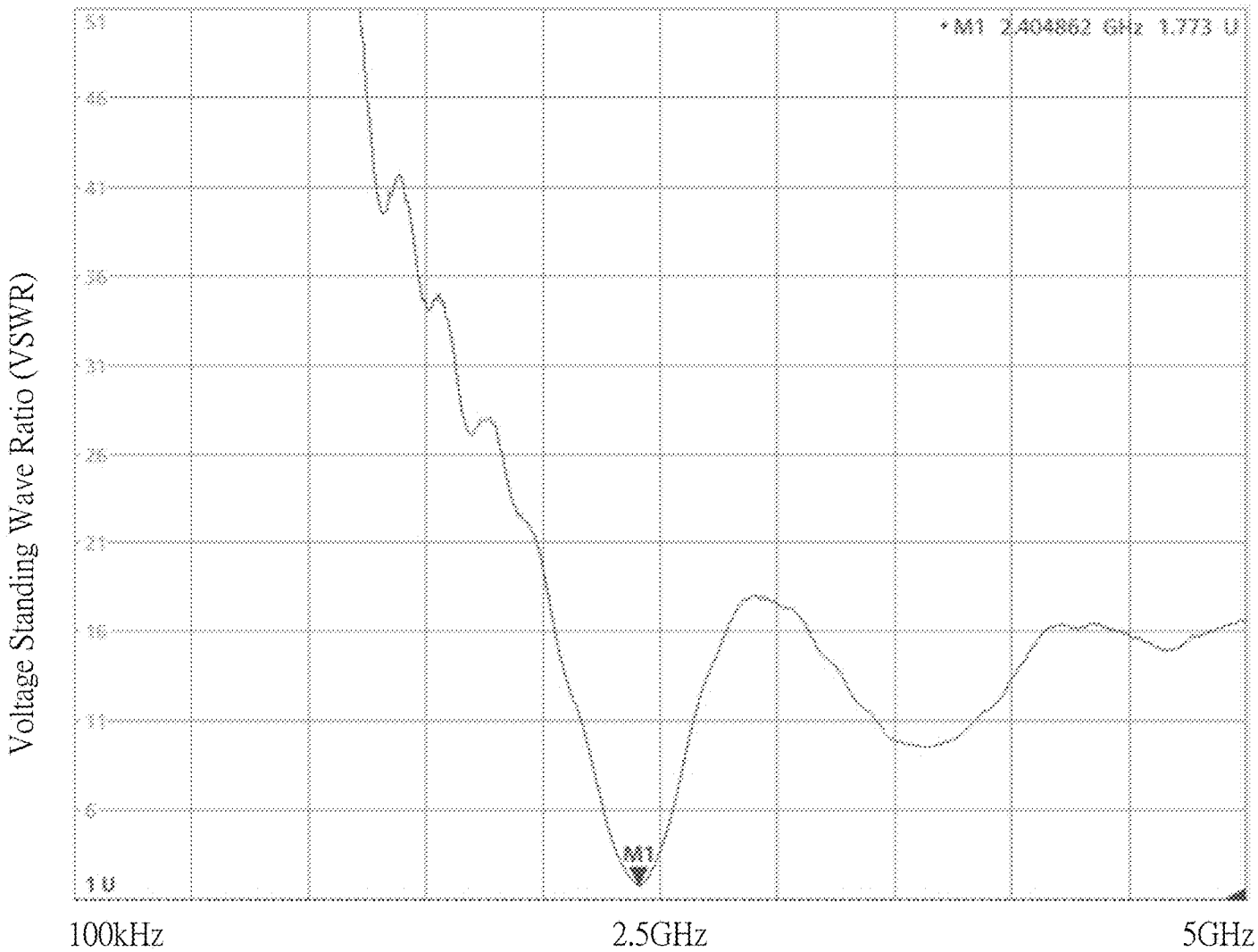
FIG.4B PRIOR ART
FIG. 4B shows a result diagram of the voltage standing wave ratio (VSWR) for a conventional dipole antenna.

(3) Furthermore, by measuring the conventional antenna structure not including the characteristics of the feeding microstrip line 13, as shown in FIGS. 4A and 4B, it can be obviously observed that, at the first operating frequency 2.3-2.45 GHz and the second operating frequency 2.35-2.5 GHz, the best gain effect is −11.1 db (as shown in FIG. 4A) and the stand wave ratio is 1.77 U (as shown in FIG. 4B), whose gain performance is apparently inferior to the two aforementioned embodiments of the present invention. Therefore, it is obvious that the feeding microstrip line 13 in the present invention can be applied to combine the effect of transmission signal enhancement.

Figure 5A:
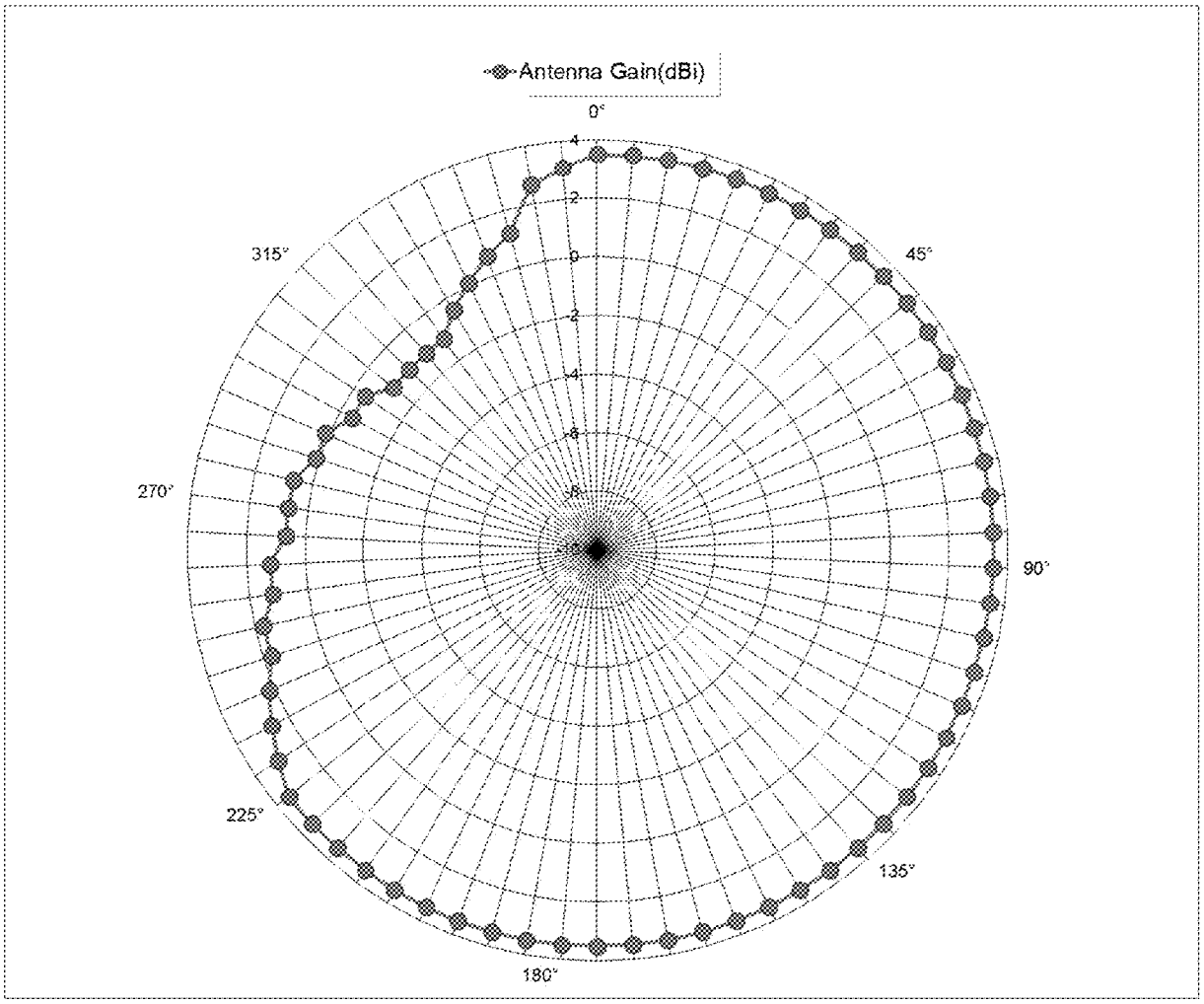
FIG. 5A shows a result diagram of the antenna gain measurement at the horizontal radiation plane of 2.4 GHz for the first embodiment of the dipole antenna according to the present invention.
Figure 5B:
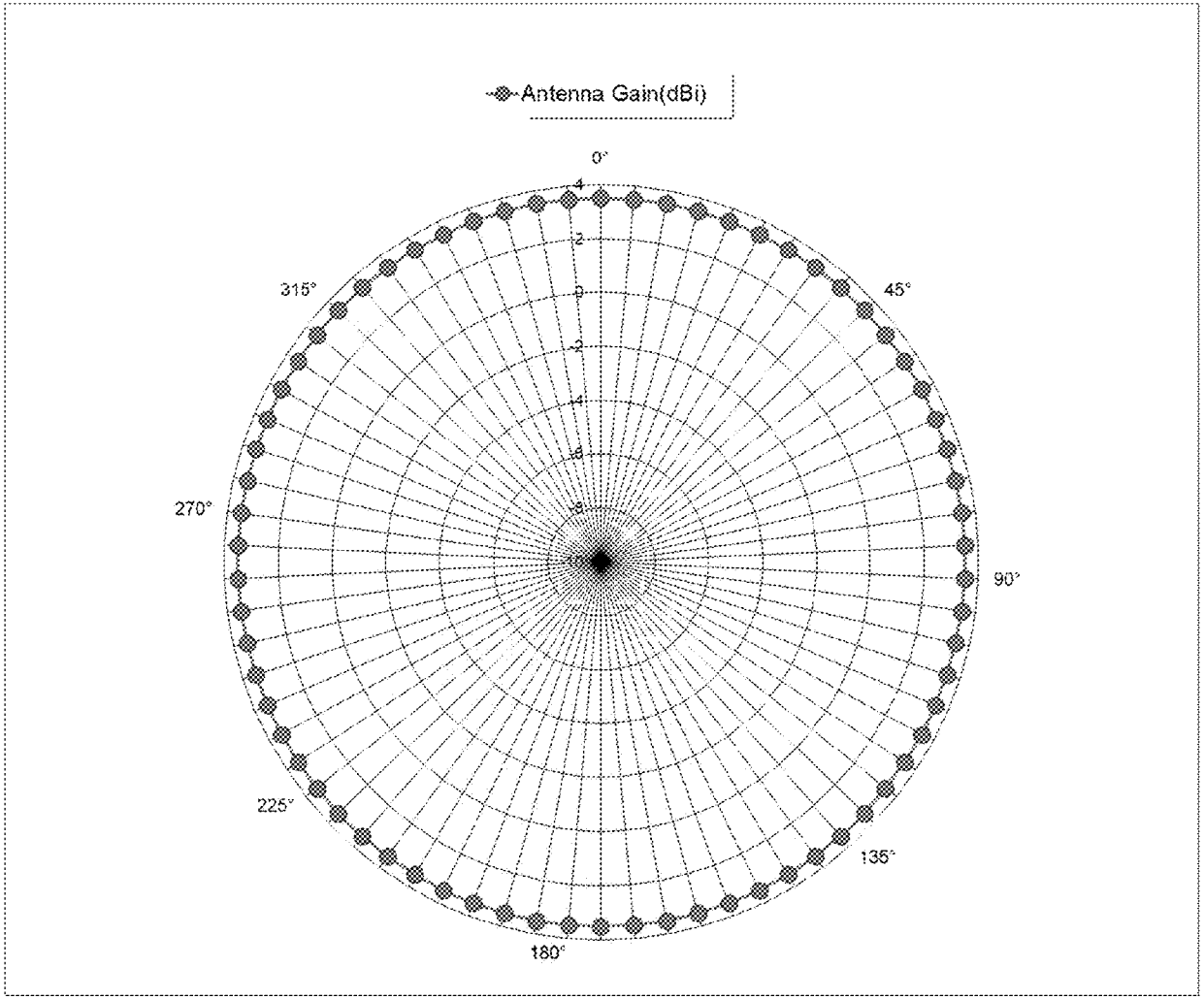
FIG. 5B shows a result diagram of the antenna gain measurement at the vertical radiation plane of 2.4 GHz for the first embodiment of the dipole antenna according to the present invention.

Moreover, as shown in FIGS. 5A and 5B, the radiation range measurement is done based on the structure shown in FIG. 1A, wherein FIG. 5A shows the horizontal pattern and FIG. 5B shows the vertical pattern, and it can be understood from these Figures that, since the actual radiation distance of the dipole antenna according to the present invention is 200 meters at maximum and 120 meters at minimum, which indicates, in comparison with the Bluetooth module having the conventional antenna design, the measured results of the dipole antenna according to the present invention can increase 4 to 6 times (the BLE module with conventional antenna design enables a transmission distance of simply 20 to 30 meters).

The antenna gains and RF signal ranges are summarized as below, and it can appreciated from Tables 1 and 2 that, within the frequency bands 2.3 GHz, 2.4 GHz or 2.5 GHz, the dipole antenna according to the present invention can demonstrate pretty good gain performance based on actually measured distance results for conversions, as shown in the following Tables:

TABLE 1

Antenna Gain and RF Signal Range of Vertical Pattern

| Vertical Pattern | Antenna (dBi) | | | | | | | | |
|---|---|---|---|---|---|---|---|---|---|
| RF range vs Angle | 0 | 45 | 90 | 135 | 180 | 225 | 270 | 315 | 360 |
| 200 | 3.50 | 3.50 | 3.50 | 3.50 | 3.50 | 3.50 | 3.50 | 3.50 | 3.50 |
| 190 | 3.08 | 3.08 | 3.08 | 3.08 | 3.08 | 3.08 | 3.08 | 3.08 | 3.08 |
| 180 | 2.65 | 2.65 | 2.65 | 2.65 | 2.65 | 2.65 | 2.65 | 2.65 | 2.65 |
| 170 | 2.19 | 2.19 | 2.19 | 2.19 | 2.19 | 2.19 | 2.19 | 2.19 | 2.19 |
| 160 | 1.71 | 1.71 | 1.71 | 1.71 | 1.71 | 1.71 | 1.71 | 1.71 | 1.71 |
| 150 | 1.20 | 1.20 | 1.20 | 1.20 | 1.20 | 1.20 | 1.20 | 1.20 | 1.20 |
| 140 | 0.67 | 0.67 | 0.67 | 0.67 | 0.67 | 0.67 | 0.67 | 0.67 | 0.67 |
| 130 | 0.11 | 0.11 | 0.11 | 0.11 | 0.11 | 0.11 | 0.11 | 0.11 | 0.11 |
| 120 | −0.48 | −0.48 | −0.48 | −0.48 | −0.48 | −0.48 | −0.48 | −0.48 | −0.48 |
| 110 | −1.10 | −1.10 | −1.10 | −1.10 | −1.10 | −1.10 | −1.10 | −1.10 | −1.10 |
| 100 | −1.75 | −1.75 | −1.75 | −1.75 | −1.75 | −1.75 | −1.75 | −1.75 | −1.75 |

TABLE 2

Antenna Gain and RF Signal Range of Horizontal Pattern

| Horizontal Pattern | Antenna (dBi) | | | | | | | | |
|---|---|---|---|---|---|---|---|---|---|
| RF range vs Angle | 0 | 45 | 90 | 135 | 180 | 225 | 270 | 315 | 360 |
| 200 | 3.50 | 3.50 | 3.50 | 3.50 | 3.50 | 3.50 | 3.50 | 3.50 | 3.50 |
| 190 | 3.08 | 3.08 | 3.08 | 3.08 | 3.08 | 3.08 | 3.08 | 3.08 | 3.08 |
| 180 | 2.65 | 2.65 | 2.65 | 2.65 | 2.65 | 2.65 | 2.65 | 2.65 | 2.65 |
| 170 | 2.19 | 2.19 | 2.19 | 2.19 | 2.19 | 2.19 | 2.19 | 2.19 | 2.19 |
| 160 | 1.71 | 1.71 | 1.71 | 1.71 | 1.71 | 1.71 | 1.71 | 1.71 | 1.71 |
| 150 | 1.20 | 1.20 | 1.20 | 1.20 | 1.20 | 1.20 | 1.20 | 1.20 | 1.20 |
| 140 | 0.67 | 0.67 | 0.67 | 0.67 | 0.67 | 0.67 | 0.67 | 0.67 | 0.67 |
| 130 | 0.11 | 0.11 | 0.11 | 0.11 | 0.11 | 0.11 | 0.11 | 0.11 | 0.11 |
| 120 | −0.48 | −0.48 | −0.48 | −0.48 | −0.48 | −0.48 | −0.48 | −0.48 | −0.48 |
| 110 | −1.10 | −1.10 | −1.10 | −1.10 | −1.10 | −1.10 | −1.10 | −1.10 | −1.10 |
| 100 | −1.75 | −1.75 | −1.75 | −1.75 | −1.75 | −1.75 | −1.75 | −1.75 | −1.75 |

Furthermore, since the configuration among the first radiating metallic line 111, the second radiating metallic line 121, the first vertical radiating metallic line 112 and the second vertical radiating metallic line 122 can be flexible, the system circuitry integration of the dipole antenna and the substrate 1 can be accordingly improved. In addition, the proportion of the area of the substrate 1 occupied by the dipole antenna can be effectively reduced, so that it can clearly meet the requirements concerning electronic product volume reduction.

In comparison with other conventional technologies, the dipole antenna according to the present invention provides the following advantages:

(1) The present invention provides an ultra-high-gain miniaturized single frequency dipole antenna, which can operate at a single frequency and allow to easily adjust the frequency gain matching of the antenna resonance mode in order to achieve the transmission stability of the frequency band maximum required by the wireless module/local area network system.

(2) The dipole antenna according to the present invention can be a planar structure or a spiral structure, which can be integrated with the system circuitry on the microwave substrate, in which, suppose a planar structure is applied, it is possible to allow the high integration feature with the microwave circuitry.

(3) The dipole antenna according to the present invention can operate in a wireless local area network system working within any frequency of 2.3, 2.4 or 2.5 GHz, thereby providing an ultra-high antenna gain effect in such operating frequency bands.

(4) The present invention allows to adjust the length of the first and the second radiating metallic lines so as to easily fine-tune the frequency and gain of the antenna resonance mode, thus further adjusting to the desired access frequency band and gain.

It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alterations and modifications after having comprehended the aforementioned technical characteristics and embodiments of the present invention within the spirit and scope thereof. Hence, the scope of the present invention to be protected under patent laws should be delineated in accordance with the claims set forth hereunder in the present specification.

What is claimed is:

1. A dipole antenna, which is formed on a substrate having a ground plane, the dipole antenna comprising:

a first antenna group, including a first radiating metallic line and a first vertical radiating metallic line, in which a first intersection of the first radiating metallic line and the first vertical radiating metallic line is a first feeding point, and a first end of the first vertical radiating metallic line remote from the first feeding point is connected to a signal source, while a second end of the first radiating metallic line remote from the first feeding point is maintained at a distance from the ground plane;

a second antenna group, including a second radiating metallic line and a second vertical radiating metallic line, in which a second intersection of the second radiating metallic line and the second vertical radiating metallic line is a second feeding point, and a third end of the second radiating metallic line and a fourth end of the second vertical radiating metallic line remote from the second feeding point are connected to the ground plane; and a feeding microstrip line, in which a fifth end thereof is connected to the first vertical radiating metallic line, in which a sixth end thereof is connected to the second vertical radiating metallic line.

2. The dipole antenna of claim 1, wherein the first antenna group and the second antenna group have a nearly symmetrical feature and have a better vertical radiation performance.

3. The dipole antenna of claim 2, wherein the first antenna group and the second antenna group have a length of a quarter wavelength on the substrate and form a symmetrical pattern.

4. The dipole antenna of claim 3, wherein a part of a first wire segment of the first radiating metallic line is in perpendicular or parallel correspondence with the first vertical radiating metallic line, and a part of a second wire segment of the second radiating metallic line is in perpendicular or parallel correspondence with the second vertically radiating metallic line.

5. The dipole antenna of claim 1, wherein the first vertical radiating metallic line, the second vertical radiating metallic line or the feeding microstrip line are straight lines, and the first vertical radiating metallic line and the second vertical radiating metallic line are in a parallel configuration.

6. The dipole antenna of claim 1, wherein a first resonance path starting from the first radiating metallic line to the first vertical radiating metallic line is used to define a first operating frequency of the dipole antenna, and a second resonance path starting from the second radiating metallic line to the second vertical radiating metallic line is used to define a second operating frequency of the dipole antenna.

7. The dipole antenna of claim 6, wherein the first antenna group is at the first operating frequency of 2.3-2.45 GHz and having a first wire length of 31-35 mm, and the second antenna group is at the second operating frequency of 2.35-2.5 GHz and having a second wire length of 28-33 mm, such that the wire lengths are adjusted based on the frequency changes, thereby achieving optimal antenna gain.

8. The dipole antenna of claim 1, wherein the substrate includes a first surface and a second surface, the first antenna group and the second antenna group are arranged on the first surface, and the second surface has a circuit configuration area and the ground plane.

9. The dipole antenna of claim 1, wherein the first radiating metallic line and the second radiating metallic line are configured on the substrate in a planar or spiral shape.

10. The dipole antenna of claim 1, wherein the two ends of the feeding microstrip line are connected to the first feeding point and the second feeding point respectively.

* * * * *